US006823569B2

(12) United States Patent
Cohen et al.

(10) Patent No.: US 6,823,569 B2
(45) Date of Patent: Nov. 30, 2004

(54) PROCESS FOR THE MANUFACTURE OF SUPER FINE WOVEN WOOL FABRIC WITH SINGLE YARN IN THE WARP HAVING IMPROVED WEAVABILITY

(75) Inventors: Yacov Cohen, Makabim (IL); Klaudia Pelman, Beer-Sheva (IL)

(73) Assignee: Polgat Textiles Co., Kiryat Gat (IL)

( * ) Notice: Subject to any disclaimer, the term of this patent is extended or adjusted under 35 U.S.C. 154(b) by 283 days.

(21) Appl. No.: 09/894,483

(22) Filed: Jun. 28, 2001

(65) Prior Publication Data

US 2002/0133924 A1 Sep. 26, 2002

(30) Foreign Application Priority Data

Mar. 26, 2001 (IL) ..... 142252

(51) Int. Cl.[7] ..... D03D 15/00
(52) U.S. Cl. ..... 28/168
(58) Field of Search ..... 28/168, 151, 155, 28/170, 218, 165, 166, 167, 171, 178; 57/3, 4, 6, 210, 207, 7, 12, 236, 238; 139/36, 291 R, 420 R, 424, 420 A, 426 R, 420 B, 420 C, 420 D

(56) References Cited

U.S. PATENT DOCUMENTS

| | | | | | |
|---|---|---|---|---|---|
| 1,677,852 | A | * | 7/1928 | Schaefer, Jr. | 28/168 |
| 1,834,388 | A | * | 12/1931 | Dreyfuss et al. | 57/362 |
| 2,155,212 | A | * | 4/1939 | Zenorini | 112/403 |
| 2,267,790 | A | * | 12/1941 | Dickie et al. | 8/114.6 |
| 2,365,315 | A | * | 12/1944 | Williams | 28/164 |
| 2,387,320 | A | * | 10/1945 | Foster | 57/211 |
| 2,435,543 | A | * | 2/1948 | Johnson et al. | 28/155 |
| 2,450,948 | A | * | 10/1948 | Foster | 156/148 |
| 2,541,804 | A | * | 2/1951 | Wormell | 264/202 |
| 2,592,153 | A | * | 4/1952 | Johnson et al. | 28/168 |
| 2,592,154 | A | * | 4/1952 | Johnson et al. | 28/168 |
| 2,609,569 | A | * | 9/1952 | Walter et al. | 106/194.2 |
| 2,731,788 | A | * | 1/1956 | Donaldson, Jr. | 57/238 |
| 2,989,797 | A | * | 6/1961 | Nusslein | 28/166 |
| 3,377,678 | A | * | 4/1968 | Moriya | 28/164 |
| 3,751,897 | A | | 8/1973 | Bailey | |
| 3,885,277 | A | * | 5/1975 | Schutz et al. | 118/68 |
| 3,909,477 | A | * | 9/1975 | Madison et al. | 524/285 |
| 5,401,557 | A | | 3/1995 | Inomata et al. | |
| 5,577,307 | A | * | 11/1996 | Itoi | 28/168 |

FOREIGN PATENT DOCUMENTS

| | | |
|---|---|---|
| EP | 0477525 | * 10/1994 |
| GB | 653529 | 5/1951 |
| GB | 775387 | 5/1957 |
| GB | 1075114 | 7/1967 |
| GB | 1075115 | 7/1967 |
| GB | 1077533 | 8/1967 |

OTHER PUBLICATIONS

Patent Abstracts of Japan, Publication No. 61023309, vol. 010, No. 170 (E–412); published Jan. 31, 1986.
Patent Abstracts of Japan, Publication No. 06 093531, vol. 018, No. 367 (C–1223), published Apr. 5, 1994.

* cited by examiner

*Primary Examiner*—A. Vanatta
(74) *Attorney, Agent, or Firm*—Hodgson Russ LLP

(57) ABSTRACT

A process for the production of a worsted wool fabric. A single wool yarn is shielded by wrapping a polymeric filament around it, to form a combined yarn. The combined yarn is weaved and subsequently the shielding polymer, which may be a synthetic polymer, is separated from the wool. The single wool yarn may be dyed prior to weaving and the wool may be roving.

21 Claims, 6 Drawing Sheets

PROCESS FOR THE MANUFACTURE OF SUPER FINE WOVEN WOOL FABRIC WITH SINGLE YARN IN THE WARP HAVING IMPROVED WEAVABILITY

FIELD OF THE INVENTION

The present invention relates to a process for the manufacture of super fine woven worsted wool fabric. More particularly, the invention relates to a process by which a polymer filament is combined with single wool yarn, and consequently reaching higher resistance toward abrasion, higher tensile strength and reducing the hairiness of the yarn.

BACKGROUND OF THE INVENTION

The manufacture of woven wool fabric is a well-known multistep process. Usually worsted weaving yarns are spun into a single yarn structure and then plied, e.g., two single yarns are twisted together in the opposite direction of the spinning twist (regular yarn) or in the same direction of the spinning twist (crepe yarn). Yarns are twisted together (folded yarn) in order to trap into the structure the surface fibers, which subsequently leads to sufficient yarn abrasion resistance, which enables withstanding of the loom action, allowing acceptable weaving efficiency. Another known procedure is to spin two rovings (two separate strands) of wool into siro yarn with spinning twists in "S" or "Z" direction.

The traditional approach for rendering single wool yarn is by yarn sizing. However, it is practically limited to coarser yarn counts. An alternative method is to spin, in the ring spinning frame, water-soluble staple PVA blended intimately with wool to produce a single yarn. However, this method suffers from poor weavability.

U.S. Pat. No. 3,751,897 teaches that the addition of continuous strands of PVA to asbestos produces a reinforced, high tensile strength yarn. In this patent, the core fiber is PVA surrounded by asbestos yarn.

U.S. Pat. No. 5,401,557 teaches the manufacture of water-soluble PVA thread, made from PVA fiber which has a dissolving temperature of at least 70° C. This PVA thread is used for reinforcing paper sheets or gummed tapes.

GB 1,075,115 teaches the manufacturing of knitted and woven elastic fabrics, wherein yarns of polyurethane, natural rubber or synthetic rubber having high elasticity, and water-soluble yarns of polyvinyl alcohol are twisted together, so that the elastic yarn is wound around a core of PVA yarn. The twisted yarns are either used in that state, or are shrunk in water, to provide yarns used for knitted or woven fabrics.

The prior art has so far failed to provide means by which super fine single worsted wool yarns, finer than 50 Nm (light count), which can be woven in warp into a very light fabric.

It is a purpose of the present invention to provide a method for overcoming the drawbacks of the known art, to obtain super fine worsted single wool yarn in the warp having improved weavability.

It is another purpose of the invention to provide a process to create a polymer filament shield for a single wool yarn, thus forming a shielded yarn with increased abrasion resistance, increased tensile strength, and decreased yarn hairiness.

It is yet another object of the present invention to provide a method for separating the polymeric shield from the woven article, consequently forming pure wool fabric.

It is a further purpose of the invention to provide a shielding procedure, which is inexpensive and saves production costs.

Other purposes and advantages of the invention will become apparent as the description proceeds.

SUMMARY OF THE INVENTION

The invention relates to a process for the manufacturing of a single wool yarn, which can be further used to prepare super fine woven worsted fabric. In one aspect, the invention is directed to the shielding of a wool yarn by the wrapping of a polymeric filament around it, weaving the combined yarn, and subsequently separating the shielded polymer from the wool. As will be appreciated by a skilled person, the wool can be a roving.

According to a preferred embodiment of the invention, the polymer filament is wound or spun together with a core of the wool yarn in a helicoidal fashion.

According to another preferred embodiment of the invention, the winding is by an assembly winding, and the spinning is by a bi-component process.

According to another preferred embodiment of the invention, the polymer is selected from polyhydric alcohol, typically a polyvinyl alcohol or its copolymers. Illustrative and non-limitative examples of the polymers are copolymers of acrylonitrile, acrylic acid, meta-acrylic acid and esters of these acids, and naturally occurring polymers, such as cellulosic derivatives.

According to yet another preferred embodiment of the invention, the separation is effected by dissolving the polymer in a water-based solution. The dissolving process is carried out at temperatures of 75–95° C.

The polymer is removed from the wool either prior or after the dyeing step, thereby leaving a fabric made solely of wool.

All the above and other characteristics and advantages of the invention will be further understood through the following illustrative and non-limitative examples.

DETAILED DESCRIPTION OF THE INVENTION

Figure 1:
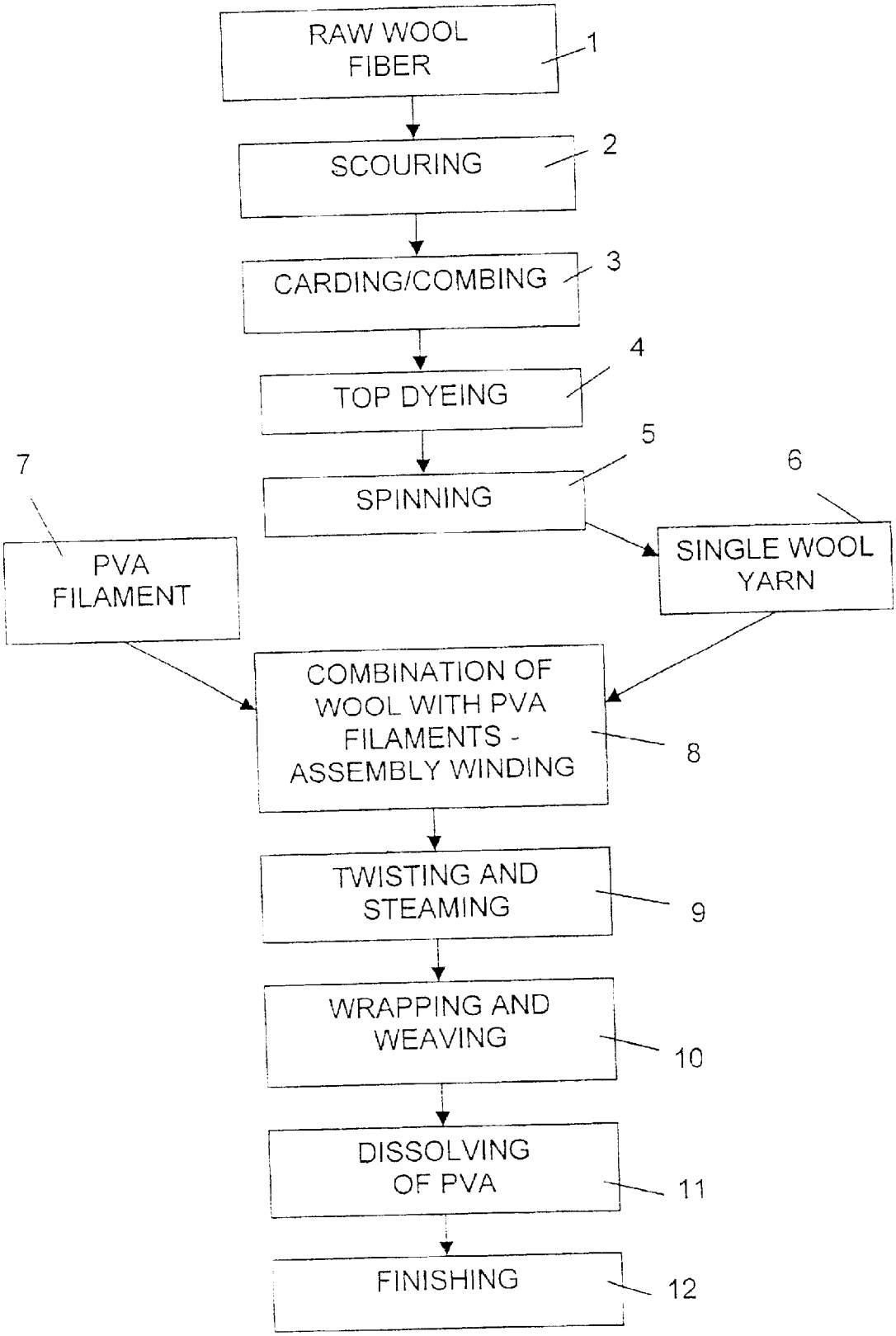
FIG. 1 is a flow-chart of the manufacturing steps of wool woven fabric through top dyeing and spinning single wool yarn, according to a preferred embodiment of the invention.

The invention relates to a process for manufacturing a super fine wool fabric that is produced through weaving a combined yarn made of PVA filament with a single worsted wool yarn or roving. The wool yarn is produced through combing, spinning and other known textile processes to yield the desired yarn. The production steps for the wool fabric are schematically illustrated in FIG. 1. A raw wool fiber is selected (1): It is subsequently treated by scouring (2), and carding/combing (3). The top wool is then dyed (4) and spun (5) to give a single wool yarn (6). The wool yarn is then combined with PVA filaments (7) by assembly winding (8), twisted and steamed (9) to avoid live yarns.

Figure 2:
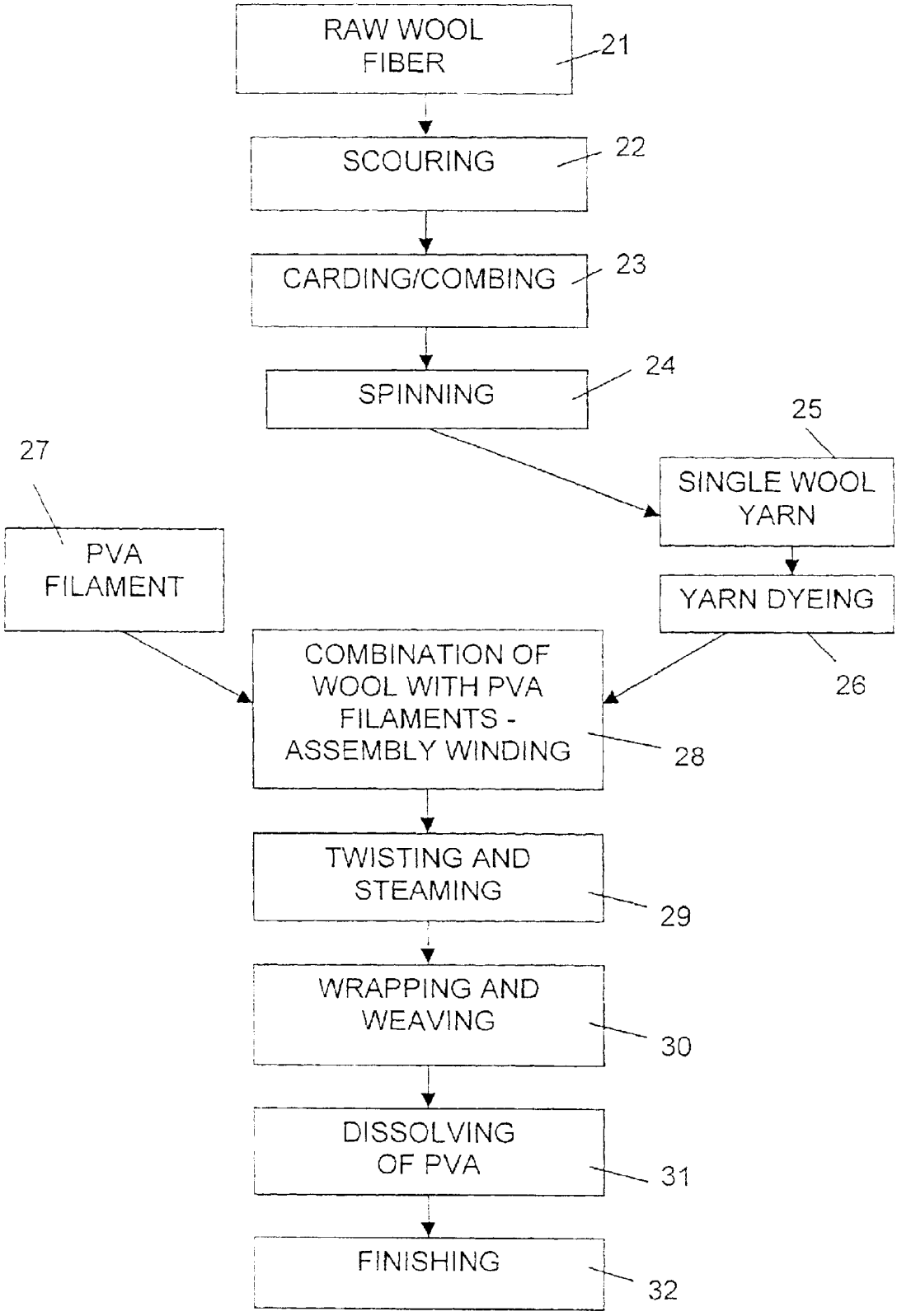
FIG. 2 is a flow-chart of a process similar to that of FIG. 1, with an added yarn dyeing step.

FIG. 2 schematically illustrates an alternative process in which color and solid-shades woven fabric is formed. Steps 21–23 are same as steps 1–3 of FIG. 1. After combing, the material is spun (24) to produce a single wool yarn (25), which is then dyed (26). The dyed yarn is then combined with PVA filament (27) by assembly winding, to produce a combined yarn (10, 28). The next steps are the same as in FIG. 1.

Figure 3:
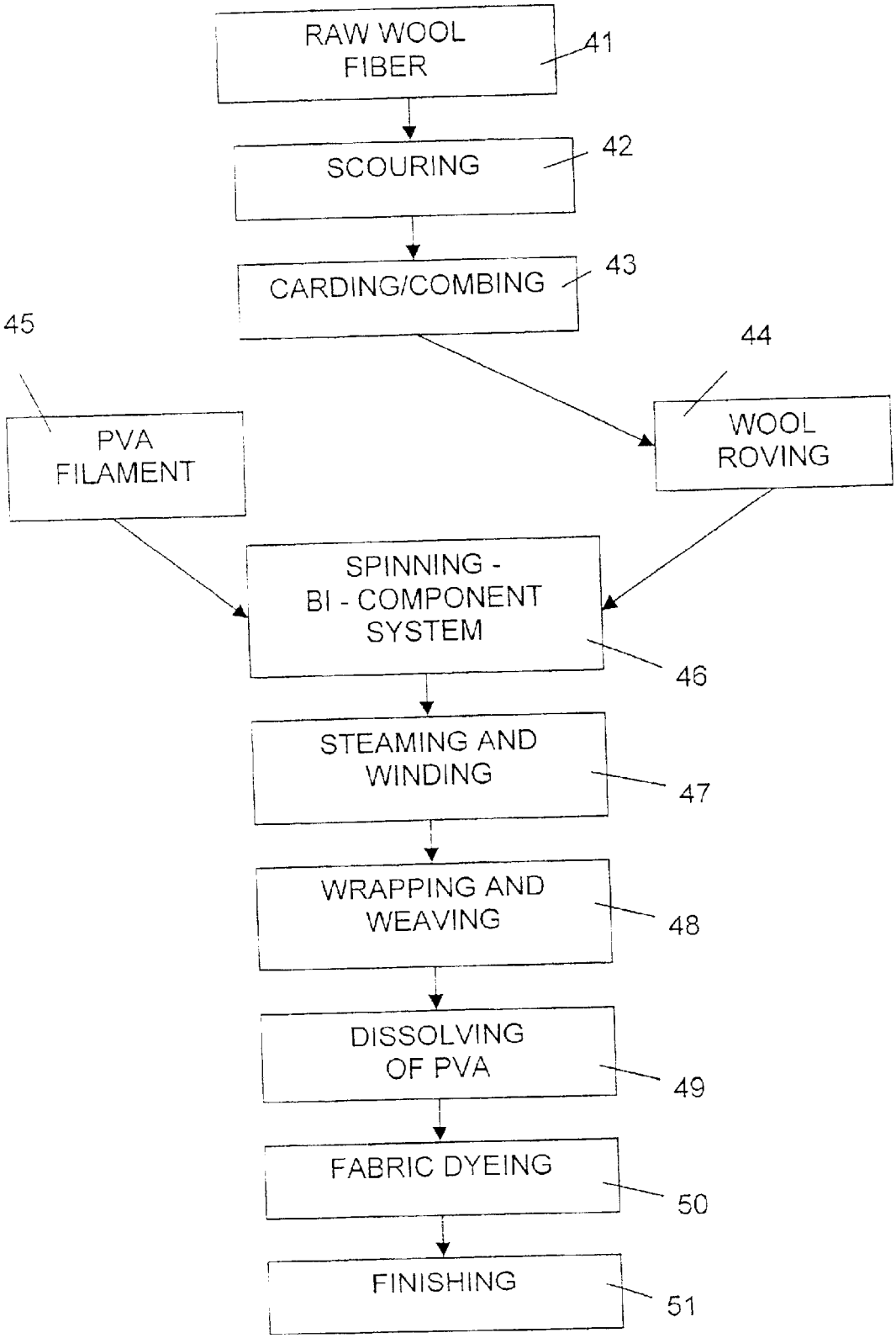
FIG. 3 is a flow-chart of the manufacture steps of wool woven fabric from a wool roving by bi-component process.

The production of solid-shaded fabric by bi-component process is schematically illustrated in FIG. 3. Following the steps of raw wool scouring and carding/combing (41–43), a wool roving (44) is combined with PVA filament (45) in a bi-component system, in a spinning frame (46). The bi-component system permits to avoid the need for the twisting process. After steaming, winding (47), wrapping and weaving (48), the PVA is dissolved (49) and the fabric is dyed (50).

Figure 4:
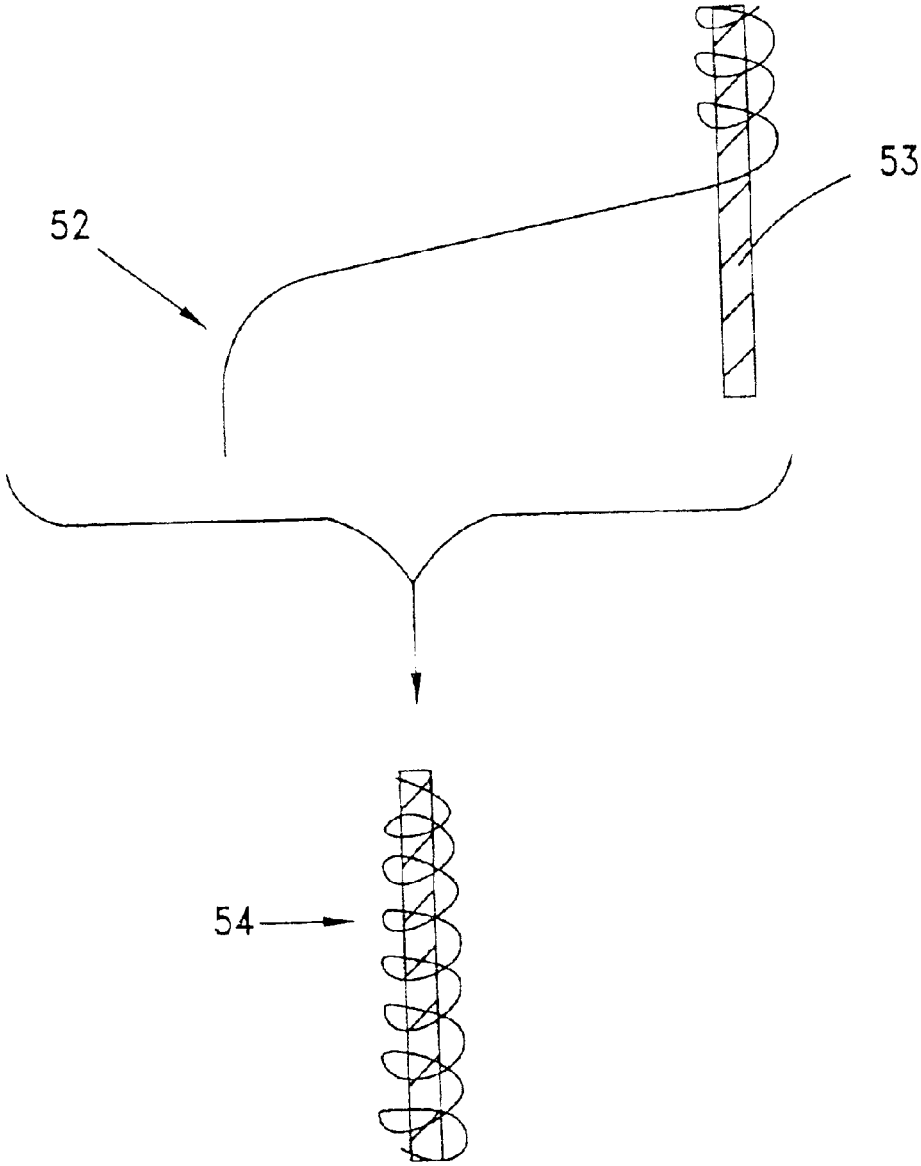
FIG. 4 is a schematic representation of the two components combination (wool and PVA) used in a preferred embodiment of the present invention.

FIG. 4 schematically illustrates the process, wherein a continuous polymer filament 52 is wound or spun together with a core of single wool yarn or roving 53, respectively, forming a shield consisting of a rigid helicoidal wrapping, 54. The combined yarn is then wrapped and woven into a fabric in a weaving machine (8, FIG. 1; 30, FIG. 2; 48, FIG. 3). The polymer is then separated from the wool (11, FIG. 1; 31, FIG. 2; 49, FIG. 3). For example, in the case of water-soluble PVA, the formed fabric is immersed into a hot water vessel and the PVA is dissolved, PVA residues being discarded by draining, thus forming a fabric based essentially on pure wool.

Figure 5A:
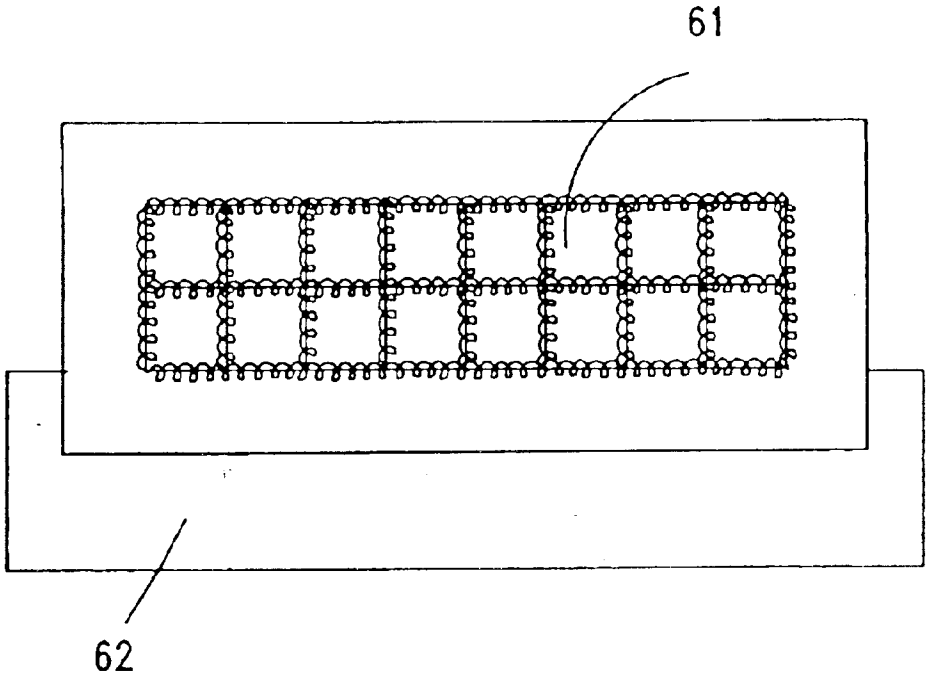
FIGS. 5A and 5B is a schematic illustration of the separation step of PVA from wool.
Figure 5B:
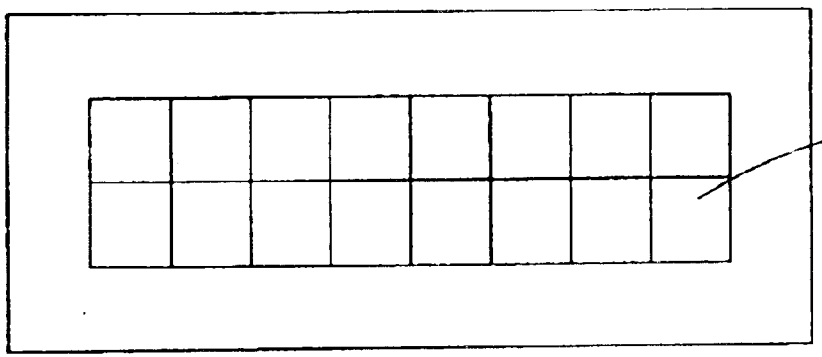

FIGS. 5A and 5B, schematically illustrate the PVA removal process, where the fabric 61 is immersed in a hot water vessel 62, to yield an essentially pure wool fabric 63. After this step, the wet and dry finishing of the wool fabric is effected (12, FIG. 1; 32, FIG. 2; 51, FIG. 3).

The present invention provides a multi-stage process which results in pure woven wool fabrics (colored or solid shades), made from very fine single worsted yarns in warp and weft axis and having a 52–80 Nm final count. In order to achieve a satisfactory and efficient weaving, it is important to use a yarn with high tensile strength and relatively high friction yarn resistance.

According to a preferred embodiment of the present invention, a combined yarn is obtained when continuous polymer, e.g. PVA filament, 28 or 40 denier, with 9 filaments for 28 denier, and 12 filament for 40 denier, is wound around a wool yarn (folded yarn) to form a helicoidal shield around the wool yarn.

Examples of winding methods used are the assembly winding and bi-component spinning. The assembly winding process comprises combining the two components in parallel to one another without a twist factor, followed by a twisting process wherein the yarns are twisted together and then steamed. The purpose of this step is to relax the builded tensions inside the yarn, thus avoiding the formation of "live" yarns. The steaming is performed in an autoclave, at 70° C., in two cycles, 10 minutes each.

Figure 6:
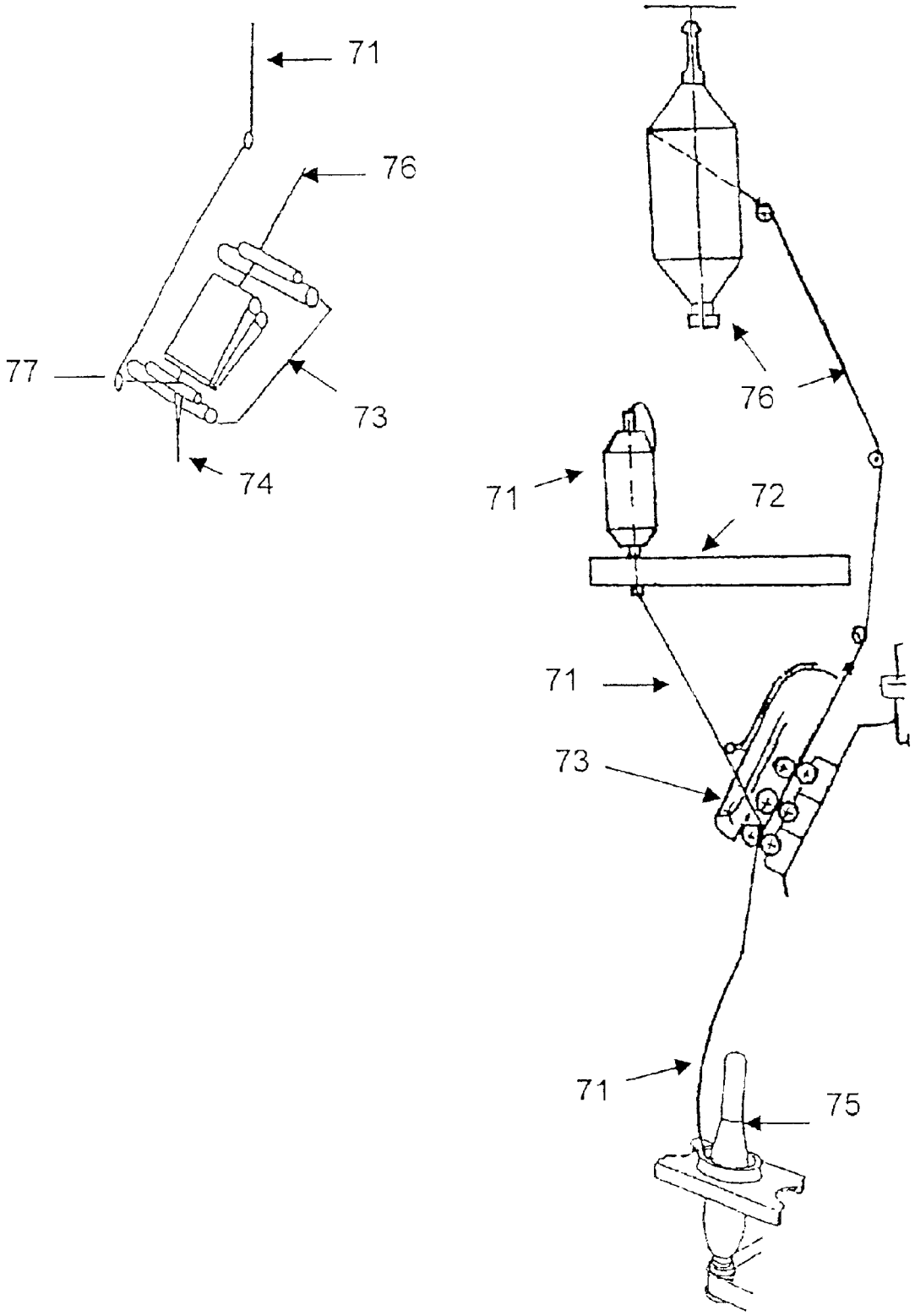
FIG. 6 is a schematic illustration of a bi-component spinning process of the combined PVA-wool yarn.

Alternatively, in the bi-component process (FIG. 6), a wool roving (76) is spun and combined with the PVA filament (71), creating a gap of 14 mm (77) between the filament entrance and the front roller, and by that leading the filament to wrap around the wool core to the rear of the drafting zone (73), and then the combined yarn (74) is spun to cops in the spinning spindle (75). The creel (72) is a device that carries the PVA filament in the spinning frame. The final yarn count is, for example, 64 Nm and it is a 19 micron yarn compared to 15.5–16 micron yarn used by the traditional processes used in the industry, for 128/2 Nm or 128/2 Nm Siro yarns.

In the case of a fabric which is based on roving, the assembly-winding, twisting step is eliminated.

In order to dissolve the PVA component, the fabric is immersed into a hot water bath at a temperature of 75–95° C. (FIG. 5A), preferably at about 80–85° C., and the fabric is kept under these conditions for 20 minutes. Thus, after dissolving, the PVA is completely discarded by draining and rinsing.

The wrapping and shielding of a single wool yarn by PVA is superior to the wrapping of a single roving with respect to the quality of the formed colored woven fabrics. The above procedure is cost-effective regarding the raw materials and production efficiency.

While PVA is referred to herein as the representative polymer, other suitable polymers can be used, such as man-made cellolusic fibers and other polyhydric alcohols, and also synthetic acrylic fibers composed of copolymers of acrylonitrile, acrylic acid, meta-acrylic acid and esters of these acids. The invention is thus not limited to the use of any specific polymer.

Separation of the polymer from wool is preferably carried out by dissolving the polymer, but can be carried out also by working the combined yarn by other means, such as radiation, which can lead to a selective degradation of the polymer. Radiation includes means of UV radiation, ionization sources, lasers and suitable ultrasonic probe.

The following examples serve to illustrate the invention, and are not intended to limit it in any way.

EXAMPLE 1

This example describes the manufacture of woven fabric with color design. A worsted single wool yarn had 52/1 Nm count in warp and weft. The weave structure was pronounced twill. The wool micron was 20.5, and the yarn weight was 150 gr./m$^2$. The tensile strength was 145 gr. This single yarn was not weavable. The single yarn was then wrapped with PVA, 18.7% owf. The yarns were twisted at 630 turns per meter (tpm). Yarn dyeing was carried out at 100° C., for 30–60 minutes, by using reactive dyestuff and metal complex 1:2.

The tensile strength of the combined 52/1 yarn was 324 gr. and it was weavable by any conventional method. The woven fabric was immersed in a hot-water bath at 80–85° C., and kept there for 20 minutes in order to dissolve the PVA, and then the fabric was rinsed and dried to remove the PVA. The procedure was completed by a known finishing process.

EXAMPLE 2

This example describes the manufacture of color-design woven fabric from worsted single wool yarn 64/1 Nm count in warp and weft, and weave structure twill 2/2. The wool micron was 19.0, and the fabric weight was 155 gr./m$^2$. The tensile strength was 113 gr. At this stage, the yarn was not weavable. The PVA filament (22.1% owf) was wrapped around the wool yarn core by assembly winding, and the yarns were twisted at 720 tpm. The tensile strength of the combined yarn was 296 gr., and it was weavable in the same process and conditions as in Example 1. The PVA dissolution, discarding, yarn dyeing and the fabric finishing steps are as described in Example 1.

EXAMPLE 3

This example describes the production of colored-design woven fabric, which is made from a single worsted wool yarn with 72/1 Nm count in warp and weft, and weave structure-birdseye. The fabric weight was 140 gr/m$^2$ and the wool micron was 18.0. The tensile strength of 72/1 yarn was 95 gr, and it was not weavable. This yarn was combined with PVA filament (24.2% owf), as described in Example 1. The yarns were twisted at 760 tpm. The tensile strength of the combined yarn was 282 gr, and it was woven according to the same conditions as in Example 1. The subsequent steps of PVA dissolution, discarding and fabric finishing were as describe in Example 2.

EXAMPLE 4

This example describes solid shaded woven fabric. This fabric is made from worsted single wool 64/1 Nm count in warp and weft, with weave structure-venetion. The wool micron was 19.0. The fabric weight was 160 gr/m$^2$. The tensile strength of the yarn was 89 gr and it was not weavable. The wool yarn was wrapped by PVA filament (22.1% owf), and the yarns were twisted at 720 tpm.

The tensile strength of the combined yarn was 287 gr and it was weavable. The process was according to FIGS. 2 and 3, including fabric dyeing at 100° C. for 20 minutes with acid metal complex 1:2. Other production steps and conditions were as described in Examples 1 and 2.

While embodiments of the invention have been described by way of illustration, it will be understood that the invention can be carried out by persons skilled in the art with many modifications, variations and adaptations, without departing from its spirit or exceeding the scope of the claims.

What is claimed is:

1. A process for the production of a worsted wool fabric, comprising shielding a single wool yarn by wrapping a water soluble polymeric filament around the yarn and in the same direction, to form a combined yarn, weaving the combined yarn and subsequently separating the shielding polymer from the wool by dissolving in water.

2. A process according to claim 1, wherein the single wool yarn is dyed prior to weaving.

3. A process according to claim 1, wherein the said wool fiber is roving.

4. A process according to claim 1, wherein the polymeric filament comprises a synthetic polymer.

5. A process according to claim 4, wherein the polymeric filament a polyhydric alcohol (polyol).

6. A process according to claim 5, wherein the polymeric filament is selected from the group consisting of polyvinyl alcohols, and copolymers of polyvinyl alcohols.

7. A process according to claim 6, wherein the polyvinyl alcohol is water-soluble.

8. A process according to claim 4, wherein the polymer is selected from the group consisting of copolymers of acrylonitrile, acrylic acid, meta-acrylic acid and esters of these acids.

9. A process according to claim 1, wherein the polymer is a naturally occurring polymer.

10. A process according to claim 9, wherein the polymer is a cellulosic derivative.

11. A process according to claim 1, wherein the polymer is a continuous filament.

12. A process according to claim 1, wherein the wool diameter is from 17 to 21 microns.

13. A process according to claim 1, wherein the polymeric filament is wound or spun together with a core of the wool yarn in a helicoidal fashion.

14. A process according to claim 13, wherein the winding is by an assembly winding.

15. A process according to claim 13, wherein the spinning is by bi-component process.

16. A process according to claim 1, wherein the process is carried out at a temperature range between 75–95° C.

17. A process according to claim 1, wherein a steaming step is applied to the combined yarn prior to weaving.

18. A process according to claim 1, wherein the polymeric filament is removed from the wool prior to dyeing, thereby leaving a fabric made essentially solely of wool.

19. A process according to claim 2, wherein the polymeric filament is removed from the wool after the dyeing step, thereby leaving a fabric made essentially solely of wool.

20. A woven textile article, garment or a cloth, made by the process disclosed in claim 1.

21. A process according to claim 1, wherein the polymeric filament comprises a film.

* * * * *